US005355636A

United States Patent [19]

Harmon

[11] Patent Number: 5,355,636

[45] **Date of Patent: * Oct. 18, 1994**

[54] TEAR RESISTANT COATED ABRASIVE ARTICLE

[75] Inventor: Kimberly K. Harmon, Hudson, Wis.

[73] Assignee: Minnesota Mining and Manufacturing Company, St. Paul, Minn.

[ * ] Notice: The portion of the term of this patent subsequent to Oct. 1, 2009 has been disclaimed.

[21] Appl. No.: 955,046

[22] Filed: Oct. 1, 1992

[51] Int. Cl.[5] ..... B24D 11/00

[52] U.S. Cl. ..... 51/295; 51/297; 51/298; 51/309; 428/480

[58] Field of Search ..... 51/295, 297, 298, 309; 428/480

[56] References Cited

U.S. PATENT DOCUMENTS

| | | | |
|---|---|---|---|
| 3,188,265 | 6/1965 | Charbonneau | 161/188 |
| 3,485,912 | 12/1969 | Schrenk et al. | 264/171 |
| 3,487,505 | 1/1970 | Chisholm | 18/13 |
| 3,565,985 | 2/1971 | Schrenk et al. | 264/171 |
| 3,576,707 | 4/1971 | Schrenk et al. | 161/164 |
| 3,607,354 | 9/1971 | Krogh et al. | 117/41 |
| 3,647,612 | 3/1972 | Schrenk et al. | 161/165 |
| 3,711,176 | 1/1973 | Alfrey, Jr. et al. | 350/1 |
| 3,741,253 | 6/1973 | Brax et al. | 138/137 |
| 3,759,647 | 9/1973 | Schrenk et al. | 425/131 |
| 3,775,226 | 11/1973 | Windorf | 156/71 |
| 3,891,486 | 6/1975 | Willdorf | 156/71 |
| 3,899,621 | 8/1975 | Willdorf | 428/216 |
| 3,907,926 | 9/1975 | Brown et al. | 260/860 |
| 4,011,358 | 3/1977 | Roelofs | 428/287 |
| 4,081,581 | 3/1978 | Littell, Jr. | 428/138 |
| 4,091,150 | 5/1978 | Roelofs | 428/57 |
| 4,163,647 | 8/1979 | Swiatek | 51/295 |
| 4,229,186 | 10/1980 | Wilson | 51/297 |
| 4,349,469 | 9/1982 | Davis et al. | 524/765 |
| 4,540,622 | 9/1985 | Brunion et al. | 428/216 |
| 4,540,623 | 9/1985 | Im et al. | 428/220 |
| 4,563,388 | 1/1986 | Bonk et al. | 428/304.4 |
| 4,584,229 | 4/1986 | Bourelier et al. | 428/216 |
| 4,636,442 | 1/1987 | Beavers et al. | 428/480 |
| 4,643,943 | 2/1987 | Schoenberg | 428/339 |
| 4,652,274 | 3/1987 | Boettcher et al. | 51/295 |
| 4,652,275 | 3/1987 | Bloecher et al. | 51/298 |
| 4,705,707 | 11/1987 | Winter | 428/35 |
| 4,729,927 | 3/1988 | Hirose et al. | 428/430 |
| 4,749,617 | 6/1988 | Canty | 428/332 |
| 4,751,138 | 6/1988 | Tumey et al. | 51/295 |
| 4,773,920 | 9/1988 | Chasman et al. | 51/295 |

(List continued on next page.)

FOREIGN PATENT DOCUMENTS

| | | |
|---|---|---|
| 0206053 | 12/1986 | European Pat. Off. . |
| 0258063 | 2/1988 | European Pat. Off. . |
| 0426636A2 | 5/1991 | European Pat. Off. . |
| 0437942A2 | 7/1991 | European Pat. Off. . |
| 63-53943 | 10/1988 | Japan . |
| 2-16050 | 1/1990 | Japan . |
| 2-270553 | 11/1990 | Japan . |
| 3-274151 | 12/1991 | Japan . |
| 86/02396 | 4/1986 | PCT Int'l Appl. . |
| 1451331 | 4/1974 | United Kingdom . |
| 1431916 | 4/1976 | United Kingdom . |

OTHER PUBLICATIONS

Schrenk, W. J. and Alfrey, T., Jr., "Some Physical Properties of Multilayer Films", *Polymer Polymer Engineering and Science,* vol. 9, No. 6, Nov. 1969, pp. 393–399.

Im, J. and Schrenk, W. J. "Coextruded Microlayer Film and Sheet", Journal of Plastic Film and Sheeting, vol. 4, Apr. 1988, pp. 104–115.

(List continued on next page.)

*Primary Examiner*—David Brunsman
*Assistant Examiner*—Deborah Jones
*Attorney, Agent, or Firm*—Gary L. Griswold; Walter N. Kirn; Steven E. Skolnick

[57] ABSTRACT

A tear resistant coated abrasive article comprises a backing which comprises a film having at least five layers situated one on the other in a parallel array. The layers occur essentially randomly in the array and are individually selected from a stiff polyester or copolyester and a ductile polymeric material. An abrasive layer is on a surface of the backing.

39 Claims, 1 Drawing Sheet

U.S. PATENT DOCUMENTS

| | | | |
|---|---|---|---|
| 4,799,939 | 1/1989 | Bloecher et al. | 51/293 |
| 4,836,832 | 6/1989 | Tumey et al. | 51/295 |
| 4,906,523 | 3/1990 | Bilkadi et al. | 428/327 |
| 4,908,278 | 3/1990 | Bland et al. | 428/500 |
| 4,911,963 | 3/1990 | Lustig et al. | 428/36.91 |
| 4,933,234 | 6/1990 | Kobe et al. | 428/336 |
| 4,939,009 | 7/1990 | Beavers et al. | 428/35.2 |
| 4,940,616 | 7/1990 | Yatsu et al. | 428/35.7 |
| 4,945,002 | 7/1990 | Tanuma et al. | 428/425.6 |
| 4,965,108 | 10/1990 | Biel et al. | 428/35.7 |
| 4,976,898 | 12/1990 | Lustig et al. | 264/22 |
| 5,024,680 | 6/1991 | Chen et al. | 51/295 |
| 5,024,895 | 6/1991 | Kavanagh et al. | 428/437 |
| 5,034,263 | 7/1991 | Maier et al. | 428/215 |
| 5,049,164 | 9/1991 | Horton et al. | 51/295 |
| 5,059,470 | 10/1991 | Fukuda et al. | 428/142 |
| 5,108,463 | 4/1992 | Buchanan | 51/295 |
| 5,137,452 | 8/1992 | Pollock | 434/195 |

OTHER PUBLICATIONS

Research Disclosure, "Coextruded Film and Sheeting Structures of Polypropylene and Polyester", Oct. 1989.

Baer, Eric, "Advanced Polymers", *Scientific American*, Oct. 1986.

TEAR RESISTANT COATED ABRASIVE ARTICLE

BACKGROUND OF THE INVENTION

1. Field of the Invention

This invention relates to coated abrasive articles and, more particularly, to such articles which are rendered tear resistant by the use of a multilayer polymer film backing.

2. Description of the Related Art

Coated abrasive articles generally comprise a backing layer to which a multiplicity of abrasive particles are bonded. In one form, the abrasive particles are bonded to the backing by a first binder, commonly referred to as a make coat. A second binder, commonly called a size coat, is then applied over the make coat and the abrasive particles to reinforce the particles. In a second form, the abrasive particles are dispersed in a binder to provide an abrasive composite and the composite is bonded to the backing by the binder.

A wide variety of backings for coated abrasive articles are known including paper, nonwoven webs, cloth, vulcanized fibers, polymeric films and combinations thereof. For example, U.S. Pat. No. 3,607,354, "Method of Delustering Polyethylene Terephthalate Film," issued Sep. 21, 1971 to L. Krogh et al. discloses a biaxially oriented polyethylene terephthalate film for coated abrasives. British Patent Specification No. 1,451,331 "Abrasive Sheet Material," published Sep. 29, 1976 discloses an abrasive sheet backing comprising a laminate of at least one fibrous material (i.e., paper) and a dimensionally stable, preformed plastic sheet (e.g., polyester). U.S. Pat. No. 4,011,358 "Article Having a Coextruded Polyester Support Film," issued Jul. 23, 1974 to G. Roelofs discloses a backing for an abrasive sheet material. The backing comprises a biaxially oriented polyester base layer (e.g., polyethylene terephthalate, polycyclohexanedimethyl terephthalate or polyethylene naphthalate) and a thin layer of a thermoplastic, adhesion-promoting polyester.

U.S. Pat. No. 4,908,278 "Severable Multilayer Thermoplastic Film," issued Mar. 13, 1990 to R. H. Bland et al. discloses films comprising at least 5 alternating layers of brittle and ductile materials. A functional layer such as an abrasive material in a binder may be applied to one or both major surfaces of the film. It is stated that "severable" means that the film may be easily and precisely cut in a straight line with little, if any, stress cracking, whitening etc. along the severed edge.

International Patent Publication No. WO 86/02396 "Coated Abrasive Sheet Material with Improved Backing," published Apr. 24, 1986, discloses an improved backing for a coated abrasive sheet material comprising a flexible sheet (e.g., paper, polyester, polyolefins), a thermoplastic adhesive layer, and a multiplicity of reinforcing yarns.

Polyester films have found wide commercial success as backings, especially in fine grade abrasive articles (i.e., articles having fine size abrasive particles), because the flat, smooth films provide a higher cut rate and a smoother surface finish on the workpiece being abraded. Unfortunately, however, those polyester films which are presently known have limited tear resistance. When the abrasive article is a belt or disk which rotates or vibrates at high speed during use, edges of the backing may become nicked, cut or torn thereby destroying the utility of the article.

Accordingly, there is considerable need for coated abrasive articles having backings with good tear resistance.

SUMMARY OF THE INVENTION

In general, this invention relates to a tear resistant coated abrasive article comprising a backing which includes a multilayer polymeric film, and an abrasive layer on a surface of the backing. The multilayer film enhances the tear resistance of the coated abrasive article. Preferably, the film comprises at least five layers situated one on the other in a parallel array, the layers occurring essentially randomly in the array. The layers are individually selected from a stiff polyester or copolyester and a ductile polymeric material. Preferably, the stiff polyester/copolyester layers are oriented in at least one direction, more preferably biaxially oriented.

Both the thickness of the film and the individual layers which comprise the film may vary over wide limits. Multilayer films according to the invention typically have a nominal thickness of from about 7 to 500 μm, more preferably, from about 15 to 185 μm. The individual layers of stiff polyester or copolyester typically have an average nominal thickness of at least about 0.5 μm, more preferably from greater than 0.5 μm to 75 μm, and most preferably from about 1 to 25 μm. It is preferred that the ductile material layers be thinner than the stiff polyester/copolyester layers. The ductile material layers may range in average nominal thickness from greater than about 0.01 μm to less than about 5 μm, more preferably from about 0.2 to 3 μm.

Similarly, the exact order of the individual layers is not critical. The total number of layers may also vary substantially. Preferably, the film comprises at least 5 layers, more preferably from greater than 5 layers to 35 layers, and most preferably 13 layers.

Stiff polyesters and copolyesters according to the invention are typically high tensile modulus materials, preferably materials having a tensile modulus, at the temperature of interest, greater than 200 kpsi (1,380 MPa), and most preferably greater than 400 kpsi (2,760 MPa). Particularly preferred stiff polyesters and copolyesters for use in multilayer film backings according to the invention comprise the reaction product of a dicarboxylic acid component selected from the group consisting of terephthalic acid, naphthalene dicarboxylic acid and ester derivatives thereof, and a diol component selected from the group consisting of ethylene gylcol and 1,4-butanediol.

Ductile materials useful in the practice of the invention generally have a tensile modulus of less than 200 kpsi (1,300 MPa) and a tensile elongation, (as defined below) at the temperature of interest, of greater than 50%, preferably greater than 150%. The ductile polymer may be selected from, for example, ethylene copolymers, polyesters, copolyesters, polyolefins, polyamides and polyurethanes. However, a preferred ductile polymer is a copolyester comprising the reaction product of cyclohexane dicarboxylic acid (or an ester derivative thereof), cyclohexane dimenthanol and polytetramethylene glycol. The backing may further include a supplemental layer comprising a material selected from the group consisting of cloth, vulcanized fibers, paper, nonwoven goods, polymeric films and combinations thereof.

The multilayer film enhances the tear resistance of coated abrasive articles made therewith. As a result, coated abrasive articles according to the invention preferably demonstrate an Elmendorf tear test value of at least about 200 grams, more preferably at least about 250 grams in one direction of the article.

The abrasive layer typically comprises a first binder over the backing and a multiplicity of abrasive particles in the first binder. Preferably, the first binder is a glue or a resinous adhesive. The resinous adhesive may be selected from phenolic, aminoplast, urethane, acrylated urethane, epoxy, acrylated epoxy, isocyanurate, acrylated isocyanurate, ethylenically unsaturated, urea-formaldehyde, bis-maleimide, and fluorine-modified epoxy resins. The abrasive layer may further comprise a second binder over the first binder. The second binder may also be a glue or a resinous adhesive, the resinous adhesive being selected from the same group of materials from which the first binder may be selected.

The abrasive layer may also include a third binder over the second binder to assist, for example, in reducing the accumulation of swarf. A supersize coating on the first binder and a backsize layer such as a pressure sensitive adhesive or an electrically conductive material over the backing are also possible.

Abrasive particles for the abrasive layer may be selected from any of a variety of materials including fused aluminum oxide, ceramic aluminum oxide, aluminum oxide-based ceramics (which may include one or more metal oxide modifiers), heat treated aluminum oxide, silicon carbide, cofused alumina-zirconia, diamond, ceria, cubic boron nitride, and garnet as well as blends thereof.

BRIEF DESCRIPTION OF THE DRAWINGS

The invention will be more fully understood with reference to the following drawings in which similar reference numerals designate like or analogous components throughout and in which.

DETAILED DESCRIPTION OF THE PREFERRED EMBODIMENTS

Figure 1:
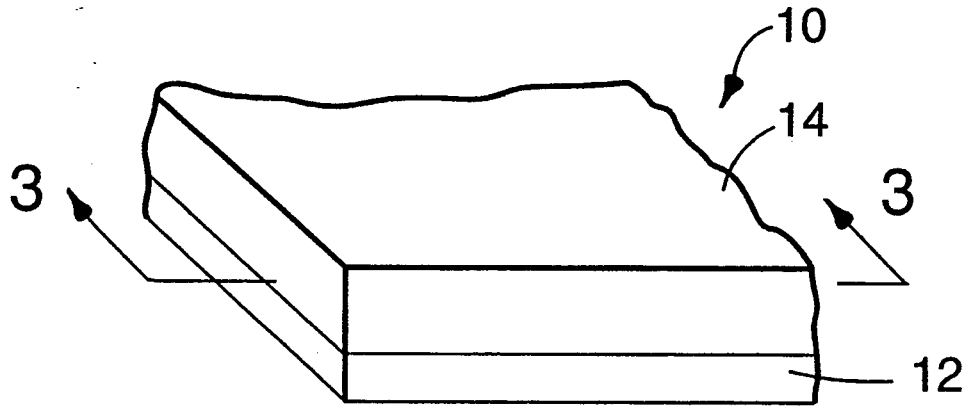
FIG. 1 is a perspective view of a coated abrasive article according to the invention.

Turning now to the drawings, FIG. 1 illustrates a coated abrasive article 10 according to the invention comprising a backing 12 and an abrasive layer 14 bonded thereto. Backing 12 includes a multilayer film 16 which enhances the tear resistance of coated abrasive article 10.

Multilayer film 16 comprises interdigitated layers of at least one ductile material, at least one stiff material and, optionally, at least one intermediate material. The exact order of the individual layers is not critical provided that at least one layer of a stiff material and at least one layer of a ductile material are present.

Examples of some multilayer film structures within the scope of the invention include:

$S(DS)_x$ $D(SD)_x$ $D(ISID)_y$ $S(IDIS)_y$ wherein S is the stiff material, D is the ductile material, I is the optional intermediate material, x is a whole number of at least 2 (preferably at least 4 and more preferably about 6), and y is a whole number of at least 1 (preferably at least 2 and more preferably about 3). Other layer arrangements in which the order is essentially random are also possible. The two outer layers may be the same or may be different. The individual stiff layers may be comprised of the same or different materials so long as the materials are stiff. Similarly, the individual ductile layers may be comprised of the same or different materials. Preferably, each stiff layer is provided by the same material and each ductile layer is the same so as to facilitate film production.

Figure 2:
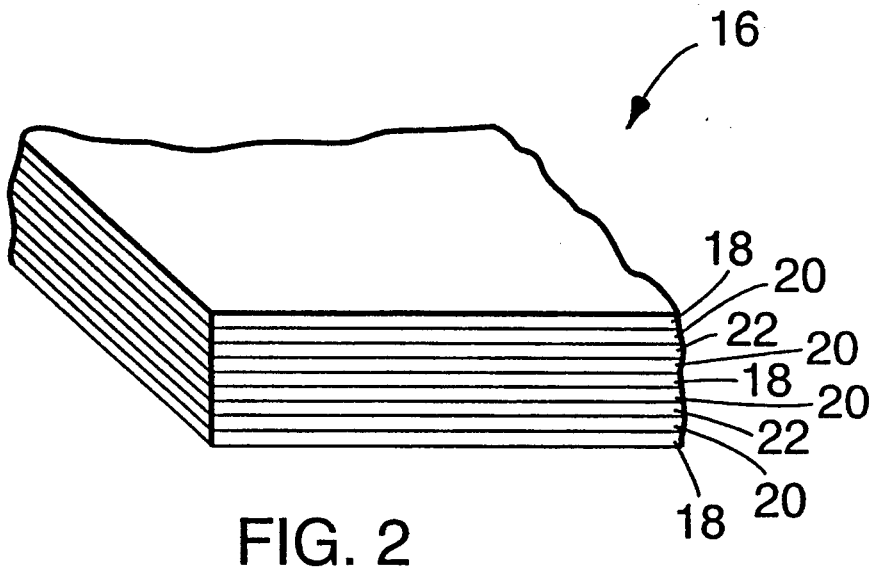
FIG. 2 is an enlarged perspective view of a length of a multilayer film useful in making coated abrasive articles according to the invention.

A multilayer film according to the invention and having the structure $D(ISID)_y$, where y is 2 is shown in FIG. 2. Multilayer film 16 includes 9 alternating layers of ductile material 18, intermediate material 20, and stiff material 22. The two outer layers are formed of ductile material 18. However, the structure of FIG. 2 could be such that either stiff material 22 or intermediate material 20 provides the outer layers. Preferably the film comprises at least 5 layers, more preferably from more than 5 layers (e.g., 9 layers) to 35 layers, and most preferably about 13 layers, although as many layers as desired (e.g., 61 layers) may be employed.

The thickness of each layer and the total thickness of the film may be varied over wide limits within the scope of the invention. The practical thickness of the film is limited only by the handling characteristics desired. The lower useful practical limit is that at which the film becomes too flimsy to be readily handled or is no longer sufficiently tear resistant while the upper useful limit is that at which the film becomes overly rigid and too difficult to process. Within these constraints, films according to the invention typically have a nominal thickness in the range of from about 7 to 500 microns (i.e., micrometers) ($\mu$m) and, more preferably, from about 15 to 185 $\mu$m.

The thickness of the individual layers may also vary over a wide range so long as the film enhances the tear resistance of coated abrasive articles made therewith, it being understood that as the number of layers increases at a constant or decreasing film thickness, the thickness of each layer declines. The individual layers of stiff material typically have an average nominal thickness of at least about 0.5 $\mu$m, more preferably from 0.5 $\mu$m to 75 $\mu$m, and most preferably from about 1 to 25 $\mu$m. Although the thickness of each layer may be the same, it is preferred that the ductile material layers be thinner than the stiff material layers. The ductile material layers may range in average nominal thickness from greater than about 0.01 $\mu$m to less than about 5 $\mu$m, more preferably, from about 0.2 to 3 $\mu$m. All film and layer thickness stated herein are nominal thicknesses which may be measured according to the procedure set forth in ASTM Test Method D 1004.

Stiff materials useful in the practice of the invention comprise polyesters which are the reaction product of dicarboxylic acid (or ester derivatives thereof) and diol components. Preferably, the dicarboxylic acid component is either terephthalic acid or naphthalene dicarboxylic acid (such as dimethyl 2,6-naphthalene dicarboxylic acid), and the diol component is either ethylene glycol or 1,4-butanediol. Accordingly, preferred polyesters for use as the stiff material include polyethylene terephthalate, polyethylene naphthalate, polybutylene terephthalate, and polybutylene naphthalate, as well as blends thereof.

Additional stiff copolyesters based on these materials may be made by copolymerizing the terephthalic and/or naphthalene dicarboxylic acid component(s) with one or more other diacids, including adipic, azelaic, sebacic, isophthalic, dibenzoic and cyclohexane dicarboxylic acids. Similarly, various stiff copolyesters may be formed by copolymerizing the ethylene glycol and/or 1,4-butanediol component(s) with one or more other diols such as diethylene glycol, propanediol, polyethyelene glycol, polytetramethylene glycol, neopentyl glycol, cylcohexane dimethanol, 4-hydroxy diphenol, bisphenol A, and 1,8-dihydroxy biphenyl. Useful stiff materials may also be provided by incorporating one or more other diacids and/or one or more other diols into the polymerization mixture. The amount of such other materials may be varied over wide limits so long as the resulting polymer is stiff.

As used herein, "stiff" means stretch resistant, creep resistant and dimensionally stable. More particularly, "stiff" materials according to the invention are high tensile modulus polyesters and copolyesters, preferably materials having a tensile modulus, at the temperature of interest, greater than 200 kpsi (kpsi=1000 pounds per square inch=6.9 MPa) (1,380 megaPascals (MPa)), more preferably greater than 300 kpsi (2,070 MPa), and most preferably greater than 400 kpsi (2,760 MPa). In some instances, orientation may be necessary to achieve the desired tensile modulus.

Tensile modulus of the stiff material is determined according to ASTM Test Method D 822-88 using a 4 inch (10.2 centimeters (cm)) gauge length and a separation rate of 2 inches/minute (5 cm/min). The "temperature of interest" means the average temperature at which the coated abrasive article is intended to be used. ASTM D 882-88 specifies a test temperature of 23° C.±2° C. If the temperature of interest for the coated abrasive article which incorporates the multilayer film is within this range, the ASTM test procedure is followed as published. If, however, the temperature of interest is outside this range, then the test procedure is followed with the exception that the test is performed at the temperature of interest.

Ductile materials useful in the invention generally have a tensile modulus of less than 200 psi (1,300 MPa) and a tensile elongation, at the temperature of interest as defined above, of greater than 50%, preferably greater than 150%. Tensile modulus and tensile elongation of the ductile material are measured in accordance with ASTM Test Method D 882-88, a tensile test, using a 4 inch (10.2 cm) gauge length and a separation rate of 5 inches/minute (12.7 cm/min). "Tensile elongation," as used herein, refers to the elongation at break of the ductile material as measured during the referenced tensile test procedure.

Suitable ductile materials include ethylene copolymers such as ethylene/vinyl acetate, ethylene/acrylic acid, ethylene/methyl acrylate, ethylene/methacrylic acid, ethylene/methyl methacrylate, ethylene/ethyl acrylate, ethylene/ethyl methacrylate and blends and ionomers thereof. Ethylene/olefin copolymers in which the olefin component is provided by propylene, butylene or other higher order alpha-olefins may also be used. Preferably, the nonethylene portion of the copolymer comprises from 5% to 30% by weight of the copolymer. Particularly useful are ethylene/vinyl acetate copolymers having at least 6 mole % vinyl acetate. Examples of suitable commercial materials include the ELVAX series of ethylene/vinyl acetate copolymers (E. I. dupont de Nemours) and the ULTRATHENE series of ethylene/vinyl acetates (Quantum Chemical Corp.).

Suitable ductile materials also include a wide variety of polyesters and copolyesters which comprise the reaction product of dicarboxylic acid (including ester derivatives thereof) and diol components. Illustrative dicarboxylic acids include terephthalic acid, isophthalic acid, naphthalene dicarboxylic acid, adipic acid, azelaic acid, sebacic acid, and cyclohexane dicarboxylic acid. Diols with which these diacids may be polymerized include ethylene glycol, diethylene glycol, propanediol, butanediol, neopentyl glycol, polyethylene glycol, polytetramethylene glycol, poly ϵ-caprolactone, polyester glycol and cyclohexane dimethanol. The relative amounts of the diacid and diol components may be varied over wide limits so long as the resulting polyester/copolyester remains ductile.

A particularly preferred ductile copolyester comprises 60 mole equivalents of terephthalic acid and 40 mole equivalents of sebacic acid to provide the dicarboxylic acid component, and 100 mole equivalents of ethylene glycol for the diol component. Another preferred copolyester comprises 100 mole equivalents cyclohexane dicarboxylic acid for the dicarboxylic acid component, and 91 mole equivalents cyclohexane dimethanol and 9 mole equivalents polytetramethylene glycol for the diol component. Examples of commercially available copolyester resins which may be used to provide the ductile material include ECDEL-9965, ECDEL-9966 and ECDEL-9967 (Eastman Chemical Products, Inc.).

Suitable ductile materials further include polyolefins such as polyethylene, polypropylene and other higher order polyolefins.

Also useful as ductile materials are polyamides in which the dicarboxylic acid component and the diamine component (of which the polyamides are the reaction product) each individually have from 2 to 12 carbon atoms. The polyamides may be copolymerized with various long chain aliphatic glycols such as polytetramethylene glycol or polyethylene glycol. The glycol may comprise up to about 25% by weight of the polyamide. Useful polyamides include the PEBAX family of resins commercially available from Atochem.

Polyurethanes comprising the reaction product of various diioscyanates or triisocyanates and active hydrogen containing compounds may also be successfully employed as ductile materials. Useful diisocyanates and triisocyanates include hexamethylene diisocyanate, trans-cyclohexane 1,4-diisocyanate, isophorone diisocyanate, 2,2,4- and 2,4,4-trimethylhexamethylene diisocyanate, m-tetramethylxylene diisocyanate, p-tetramethylxylene diisocyanate, dicyclohexylmethane 4,4-diisocyanate, dimethyl diisocyanate, m-phenylene diisocyanate, p-phenylene diisocyanate, toluene 2,4-diisocyanate, toluene 2,6 diisocyanate, naphthalene 1,5-diisocyanate, diphenylmethane 2,4'-diisocyanate, diphenylmethane 4,4'-diisocyanate, polymethylene polyphenylene polyisocyanate, triphenylmethane 4,4',4''-triisocyanate, isocyanatoethyl methacrylate, 3-isopropenyl-α, αdimethylbenzyl-isocyanate, and thiophosphoric acid, tris(4-isocyanatophenyl ester), as well as blends or mixtures thereof.

Useful active hydrogen containing materials include diols (e.g., 1,4-butanediol, 1,6-hexanediol, castor oil), polyester polyols, polyether polyols, and polyfunctional primary or secondary amines. The equivalent ratio of diisocyanate to active hydrogen is about 1:1.

It has been found that relatively small amounts of the ductile material (i.e., amounts of less than 5 weight percent), relative to the stiff material, can greatly improve the tear resistance of multilayer films and coated abrasive articles made therewith. However, as little as about 1 weight percent (weight % or wt. %), preferably at least about 2.6 weight %, of the ductile material is believed to be sufficient to provide enhanced tear resistance *Ductile material loadings up to about* 10 to 20 weight % may be used although exceeding this range may reduce the tear resistance of films and coated abrasive articles made therewith.

Preferably, films according to the invention have an interlayer adhesion of at least 1 piw (180 grams/centimeter), more preferably at least 3 piw (540 grams/centimeter), Because films of the invention comprise a number of interleaved layers of different materials, it is sometimes necessary to provide a means for increasing the interfacial adhesion between adjacent layers to achieve the desired interlayer adhesion. Several techniques may be used. For example, when the interfacial adhesion between adjacent layers of stiff and ductile components is considered inadequate, a low concentration (e.g. about 0.01 to 10%) of a component which contains an appropriate functional group may be incorporated into either or both of the ductile and stiff materials to promote interlayer adhesion. This may be accomplished by, for example, reacting or blending the functional group-containing component with the ductile or stiff material or by copolymerizing or blending it with the monomers used to provide the ductile or stiff material. Examples of useful adhesion-promoting, functional group-containing components include acrylic acid, methacrylic acid, maleic anhydride, vinyl pyridine, oxazoline-containing materials (such as polyethyl oxazoline), and the like.

Alternatively, a layer of an appropriate intermediate material may be utilized as a tie layer between the layers of stiff and ductile materials. The intermediate layer may comprise a ductile material, a stiff material, or a rubbery material. The intermediate layer could also comprise a blend of stiff and ductile materials. Ductile and stiff materials are described above. Rubbery materials manifest no significant yield point, but typically display a sigmoidal rise in elongation with applied load until rupture occurs at high strain. Whatever the precise nature of the intermediate material, if it is being used as a tie layer, it must enhance the adhesion between the stiff and ductile materials. Combinations of these approaches, or even other approaches may also be used.

Many materials are useful as the intermediate layer. They include ethylene/vinyl acetate copolymers, preferably containing at least about 10% by weight vinyl acetate and a melt index of about 10, e.g., the ELVAX series of materials (duPont); carboxylated ethylene/vinyl acetate copolymers, e.g., CXA 3101 (duPont); copolymers of ethylene and methyl acrylate, e.g., POLY-ETH 2205 EMA (available from Gulf Oil and Chemicals Co.), and ethylene methacrylic acid ionomers e.g., SURYLN (duPont); ethylene/acrylic acid copolymers; and maleic anhydride modified polyolefins and copolymers of polyolefins, e.g., MODIC resins (available from Mitsubishi Chemical Company).

Other materials useful as the intermediate layer include polyolefins containing homogeneously dispersed vinyl polymers such as the VMX resins available from Mitsubishi (e.g., FN70, an ethylene/vinyl acetate-based product having a total vinyl acetate content of 50% and JN-70, an ethylene/vinyl acetate-based product containing 23% vinyl acetate and 23% dispersed poly(-methyl methacrylate)), POLYBOND (believed to be a polyolefin grafted with acrylic acid) available from Reichold Chemicals Inc., and PLEXAR (believed to be a polyolefin grafted with polar functional groups) available from Chemplex Company. Also useful are copolymers of ethylene and methacrylic acid such as the PRIMACOR family available from Dow Chemical Co. and NUCREL available from dupont. Other ethylene copolymers such as ethylene/methyl methacrylate, ethylene/ethyl acrylate, ethylene/ethyl methacrylate and ethylene/n-butyl acrylate may be used.

The various polyesters and copolyesters described above as being suitable ductile materials may also function as an intermediate layer.

The intermediate layer preferably comprises from about 1 to 30 (most preferably from about 2 to 10) weight % of the film. The nominal thickness of the intermediate layer can vary over a wide range depending on the number of layers in the multilayer film and the overall thickness of the film, but preferably is from about 0.01 μm to less than about 5 μm, more preferably from about 0.2 to 3 μm.

Alternatively, adjacent layers of stiff and ductile materials may be treated with radiation, such as ultraviolet, electron beam, infrared or microwave radiation, to improve adhesion.

Each of the stiff, ductile and intermediate layer materials may further include or be supplemented with various adjuvants, additives, extenders, antioxidants, thermal stabilizers, ultraviolet light stabilizers, plasticizers, slip agents, etc. that are conventionally and customarily used in the manufacture of such materials or films made therewith. These supplemental materials may comprise up to about 5 weight % of the total weight of the layers into which they are incorporated so long as the tear resistance of the film and the coated abrasive article is not significantly adversely affected.

Backing 12 may comprise a laminate of multilayer film 16 and a supplemental layer 24 (see FIG. 3) such as, for example, cloth, vulcanized fibers, paper, nonwoven materials, other polymeric films and combinations thereof. Cloth supplemental layers are preferably treated with a resinous adhesive to protect the cloth fibers and to seal the cloth backing. The cloth may be woven or stitch bonded and may comprise fibers or yarns of cotton, polyester, rayon, silk, nylon or blends thereof. Nonwoven supplemental layers may comprise cellulosic fibers, synthetic fibers or blends thereof.

Multilayer film 16 and supplemental layer 24 may be laminated together using techniques well known in the industry such as passing them between a pair of heated nip rollers or compressing them in a heated press. A bonding layer (not shown separately in the drawings) such as a laminating adhesive may be disposed between the multilayer film and the supplemental layer to promote adhesion between the two materials. Useful laminating adhesives include thermoplastic resins based on polyamides, polyesters, polyurethanes and blends thereof. Thermosetting resins may also be used. Suitable examples include phenolic, aminoplast, urethane, epoxy, ethylenically unsaturated, isocyanurate, urea-formaldehyde, acrylated isocyanurate and acrylated epoxy resins as well as combinations thereof.

The particular supplemental layer and bonding layer will be selected depending on the qualities which are to be imparted to the finished coated abrasive article such as strength, heat resistance, additional tear resistance or flexibility. In some instances, the multilayer film and the supplemental layer may provide different properties. For example, a cloth supplemental layer may offer additional bulk or stiffness while the multilayer film provides a smooth, flat uniform surface for the abrasive layer.

Figure 3:
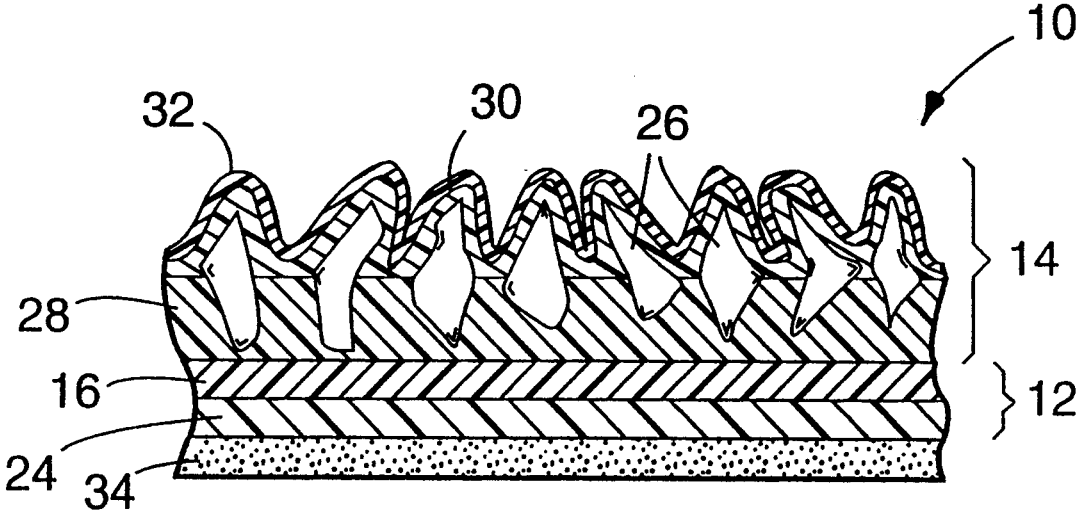
FIG. 3 is a sectional view of a coated abrasive article according to the invention and taken along lines 3—3 of FIG. 1.

Coated abrasive article 10 is shown in further detail in FIG. 3. Abrasive layer 14 comprises a multiplicity of abrasive particles 26 which are bonded to a major surface of backing 12 by a first binder or make coat 28. A second binder or size coat 30 is applied over the abrasive particles and the make coat to reinforce the particles. The abrasive particles typically have a size of about 0.1 to 1500 μm, more preferably from about 1 to 1300 μm. Preferably the abrasive particles have a MOH hardness of at least about 8, more preferably greater than 9. Examples of useful abrasive particles include fused aluminum oxide, ceramic aluminum oxide, aluminum oxide basec ceramics (which may include one or more metal oxide modifiers), heat treated aluminum oxide, silicon carbide, cofused alumina-zirconia, diamond, ceria, cubic boron nitride, garnet and blends thereof. Abrasive particles also include abrasive agglomerates such as disclosed in U.S. Pat. No. 4,652,275 and U.S. Pat. No. 4,799,939, which patents are hereby incorporated by reference.

Make coat 28 and size coat 30 each comprise a glue or a resinous adhesive. Examples of suitable resinous adhesives include phenolic, aminoplast, urethane, acrylated urethane, epoxy, acrylated epoxy, isocyanurate, acrylated isocyanurate, ethylenically unsaturated, urea-formaldehyde, bis-maleimide and fluorine-modified epoxy resins as well as mixtures thereof. Precursors for the make and size coats may further include catalysts and/or curing agents to initiate and/or accelerate the polymerization process described hereinbelow. The make and size coats are selected based on the characteristics of the finished coated abrasive article.

The make and size coats may further comprise various optional additives such as fillers, grinding aids, fibers, lubricants, wetting agents, surfactants, pigments, antifoaming agents, dyes, coupling agents, plasticizers and suspending agents. Examples of useful fillers include calcium carbonate, calcium metasilicate, silica, silicates, sulfate salts and combinations thereof. Grinding aids useful in the practice of the invention include cryolite, ammonium cryolite and potassium tetrafluoroborate.

Abrasive layer 14 may further comprise a third binder or super size coating 32. One useful super size coating comprises a grinding aid, such as potassium tetrafluoroborate, and an adhesive, such as an epoxy resin. Super size coating 32 may be included to prevent or reduce the accumulation of swarf (the material abraded from a workpiece) between abrasive particles which can dramatically reduce the cutting ability of the abrasive article. Materials useful in preventing swarf accumulation include metal salts of fatty acids (e.g., zinc stearate), urea-formaldehydes, waxes, mineral oils, crosslinked silanes, crosslinked silicones, fluorochemicals and combinations thereof. An optional back size coating 34 such as an antislip layer comprising a resinous adhesive having filler particles dispersed therein or a pressure sensitive adhesive for bonding the coated abrasive article to a support pad may be provided on backing 12. Examples of suitable pressure sensitive adhesives include latex, crepe, rosin, acrylate polymers (e.g., polybutyl acrylate and polyacrylate esters), acrylate copolymers (e.g., isooctylacrylate/acrylic acid), vinyl ethers (e.g., polyvinyl n-butyl ether), alkyd adhesives, rubber adhesives (e.g., natural rubbers, synthetic rubbers and cholorinated rubbers), and mixtures thereof.

The back size coating may also be an electrically conductive material such as vanadium pentoxide (in, for example, a sulfonated polyester), or carbon black or graphite in a binder. Examples of useful conductive back size coatings are disclosed in U.S. Pat. No. 5,108,463 and U.S. Pat. No. 5,137,452, which patents are incorporated herein by reference.

In order to promote adhesion of make coat 28, supplemental layer 24 (if such be provided), and/or back size coating 34 (if such be included), it may be necessary to modify or prime the surface to which these layers are applied. Appropriate surface modifications include corona discharge, ultraviolet light exposure, electron beam exposure, flame discharge and scuffing- Useful primers include, ethylene/acrylic acid copolymers such as disclosed in U.S. Pat. No. 3,188,265, colloidal dispersions such as taught in U.S. Pat. No. 4,906,523, aziridine-based materials such as disclosed in U.S. Pat. No. 4,749,617, and radiation grafted primers such as described in U.S. Pat. Nos. 4,563,388 and 4,933,234.

Alternatively, although not shown specifically in the drawings, abrasive layer 14 may comprise a multiplicity of abrasive particles which are dispersed in a make coat. Such structures may further comprise an optional super size coating, such as described above, over the make coat. Both the construction illustrated in FIG. 3 and one in which the abrasive particles are dispersed in a make coat are considered exemplary of abrasive layers comprising abrasive particles in a make coat or a first binder.

Coated abrasive articles according to the invention may be made by applying abrasive layer 14 to a preformed backing 12. Multilayer films 16 useful in backing 12 may be readily made using multilayer film manufacturing techniques known in the art. One such technique is disclosed in U.S. Pat. No. 3,565,985 (Schrenk et al.). In making multilayer films of the invention melt coextrusion by either the multimanifold die or the feedblock method in which individual layers meet under laminar flow conditions to provide an integral multilayer film may be used. More specifically, separate streams of the ductile, stiff and, optionally, intermediate materials in a flowable state are each split into a predetermined number of smaller or sub-streams. These smaller streams are then combined in a predetermined pattern of layers of stiff, ductile and, optionally, intermediate materials to form an array of layers of these materials in a flowable state. The layers are in intimate contact with adjacent layers in the array. This array generally comprises a tall stack of layers which is then compressed to reduce its height. In the multimanifold die approach, the film width remains constant during compression of the stack while the width is expanded in the feedblock approach. In either case, a comparatively thin, wide film results. Layer multipliers in which the resulting film is split into a plurality of individual subfilms which are then stacked one upon another to increase the number of layers in the ultimate film may also be used.

In manufacturing the films, the materials may be fed such that any one of the three constitutes the outer layer. The two outer layers often comprise the same material. Preferably, the materials comprising the various layers are processable at the same temperature and have similar melt viscosities so as to avoid degrading a lower melting material. Accordingly, residence time and processing temperatures may have to be adjusted depending on the characteristics of the materials of each layer.

Other manufacturing techniques such as lamination, coating or extrusion coating may be used in assembling multilayer films useful in the invention. For example, in lamination, the various layers of the film are brought together under temperature and/or pressure (e.g., using heated laminating rollers or a heated press) to adhere adjacent layers to each other. In extrusion coating, a first layer is extruded onto either a cast web, a monoaxially oriented film or a biaxially oriented film and subsequent layers are sequentially coated onto the previously provided layers. Exemplary of this method is U.S. Pat. No. 3,741,253. Extrusion coating may be preferred over the melt coextrusion process described above where it is desirable to pretreat selected layers of the multilayer film or where the materials are not readily coextrudable.

It is preferred that the layers of the stiff material be oriented, either uniaxially or biaxially, at a temperature above their glass transition temperature so as to enhance the stiffness, modulus and creep resistance of the film. Orientation of the ductile and intermediate layer materials is optional. Orientation may be accomplished by conventional methods typically used in the art such as mechanical stretching (drawing) or tubular expansion with heated air or gas. Typical draw ratios are in the range of 2.5 to 6 times in either or both of the machine and transverse directions. Greater draw ratios (for example, up to about 8 times) may be used if the film is oriented in only one direction. The film need not be stretched equally in the machine and transverse directions although this is preferred if balanced properties are desired.

The films may also be heat set by exposing the film to a temperature of about 10° C. to 150° C. below the melting temperature of the stiff component for about 4 to 15 seconds so as to increase the crystallinity, stiffness, modulus and creep resistance of the film while reducing its tendency to shrink. In applications where film shrinkage is not of significant concern, the film may be heat set at relatively low temperatures or not at all. On the other hand, as the temperature at which the film is heat set is increased, the tear resistance of the film may change. Thus, the actual heat set temperature and time will vary depending on the composition of the film but should not be selected so as to substantially degrade the tear resistant properties of the film. Within these constraints, a heat set temperature of about 135° to 205° C. is generally desirable.

Supplemental layer 24, if such is provided, may be laminated to film 16 as described above.

Once backing 12 has been provided, make coat 28 is applied to a major surface thereof as a flowable liquid. A multiplicity of abrasive particles are projected into the make coat, preferably by electrostatic coating, and the resulting construction is at least partially cured. Size coat 30 may be applied as a flowable liquid over the abrasive particles and the make coat. The size coat is then fully cured along with, if necessary, the make coat. The make and size coats may be applied by a variety of techniques such as roll coating, spray coating or curtain coating and can be cured by drying, heating, or with electron beam or ultraviolet light radiation. The particular curing approach may vary depending on the chemistries of the make and size coats. Optional super size coating 32 may be applied and cured in a similar manner.

Alternatively, if the abrasive layer comprises a dispersion of abrasive particles in a make coat, an abrasive slurry comprising the particles and the make coat is prepared and coated onto the backing by spraying, roll coating, dip coating, knife coating, and the like. The make coat may then be cured by any of the processes described above.

Optional back size coating 34 may be applied to backing 12 or supplemental layer 24 using any of a variety of conventional coating techniques such as dip coating, roll coating, spraying, Meyer bar, doctor blade, gravure printing, thermomass transfer, flexographic printing, screen printing, and the like.

Coated abrasive articles according to the invention are tear resistant. By tear resistant it is meant that, in comparison to conventional coated abrasive articles employing paper or polyester film backings, coated abrasive articles according to the invention are less likely to become nicked or torn during routine intended use. In the event that a coated abrasive article of the invention does suffer a cut or nick during use, the properties of the multilayer film which comprise the backing are such that further advancement of the already formed tear is usefully resisted. The coated abrasive articles of the invention are also flexibile, an important consideration when the article is used to abrade a contoured workpiece. The coated abrasive article should have sufficient flexibility to permit it to conform to the contours of the workpiece.

The tear resistance of coated abrasive articles (and multilayer film backings therefor) was evaluated by an Elmendorf tear test according to the procedure set forth in ASTM D 689-79, Standard Test Method for Internal Tear Resistance of Paper. The data are reported in grams (g), higher values indicating greater tear resistance. Data were recorded in both the machine direction (MD) (the direction in which multilayer film 16 was extruded or the vertical direction) and the transverse direction (TD) (orthogonal to the machine direction). Preferably, coated abrasive articles according to the invention demonstrate an Elmendorf tear test value of at least about 200 g, more preferably at least about 250 g in one direction of the article.

Flexibility of coated abrasive articles was measured in a Taber Flex Test in which a coated abrasive article sample measuring 3.8 cm by 7.0 cm was mounted vertically in a Taber V5 Stiffness Tester (Model 150B). A force sufficient to deflect the sample 15° was applied. The force was recorded, larger values indicating stiffer, less flexible materials. Articles were tested in both the machine and transverse directions. The unit of measure for the Taber Flex Test is the bending moment in grams which results from applying a mass of 0.2 g to a 5 cm by 3.8 cm specimen so as to deflect the specimen by 15°.

The invention will be more fully appreciated with reference to the following non-limiting examples in which all parts and percentages are by weight unless indicated otherwise.

Examples 1 to 5 and comparative examples (C.E.) 1 to 7 assess the tear resistance of uncoated multilayer backings suitable for use in coated abrasive articles according to the invention and several presently known, commercially available backings, following the procedures described more fully above. The results of these tests are shown below in Table 3.

EXAMPLE 1

A multilayer film useful as a backing for a tear resistant coated abrasive article and comprising 13 alternating layers of a stiff material and a ductile material was formed by coextruding polyethylene terephthalate (PET) (differential scanning calorimetry (DSC) melting point of 256° C.; intrinsic viscosity of 0.60 deciliters per gram (dl/g) as measured in 60% phenol and 40% dichlorobenzene at 110° C.) as the stiff material with 7 wt. % of a copolyester as the ductile material. The copolyester comprised 40 mole % (or mole equivalents herein as the reactive systems are basd on 100 equivalents) sebacic acid and 60 mole % terephthalic acid as the dicarboxylic acid components, and 100 mole % ethylene glycol as the diol component. The copolyester had an intrinsic viscosity in the range of 0.9 to 1.05 dl/g when measured in the same fashion as the PET. The ductile copolyester also displayed a tensile modulus of 14 kpsi (97 MPa) and a tensile elongation of 355% when tested as described above.

The multilayer film was coextruded onto a chilled casting wheel and subsequently sequentially oriented 2.6 times in the machine direction at 80° C. and 4.2 times in the transverse direction at 99° C. The film was then heat set at 149° C. The film had a nominal thickness of about 51 μm.

EXAMPLE 2

A multilayer film backing for a tear resistant coated abrasive article and comprising a total of 13 alternating layers of the stiff material of example 1 and 9.7 wt.% of a ductile material provided by ECDEL 9966 (believed to be a copolyester based on 1,4-cyclohexane dicarboxylic acid, 1,4-cyclohexane dimethanol, and polytetramethylene ether glycol) was coextruded onto a chilled quenching wheel. When tested according to the procedure described above, the ductile material of example 2 was found to have a tensile modulus of 26 kpsi (189 MPa) and a tensile elongation of 630%. The film was subsequently simultaneously oriented 3.3 times in both the machine and transverse directions at 99° C. and heat set at 135° C. The nominal thickness of the film was about 51 μm. The multilayer film backing of this example displayed poor interlayer adhesion which it is believed can be remedied through the inclusion of an appropriate tie layer such as discussed more fully hereinabove. However, as shown in Table 2, the multilayer film of this example had excellent tear resistance.

EXAMPLE 3

A multilayer film backing for a tear resistant coated abrasive article comprising 13 alternating layers of a stiff PET (DSC melting point=256° C.; intrinsic viscosity=0.72 dl/g) coextruded with 20 wt. % of a ductile ethylene/vinyl acetate copolymer having 18% vinyl acetate and a melt index of 8.0 (measured by ASTM test method D 1238) was cast onto a chilled quenching wheel. The film was subsequently sequentially oriented 3.2 times at 93° C. in the machine direction and 3.5 times at 102° C. in the transverse direction followed by heat setting at 204° C. The nominal thickness of the film was approximately 38 μm.

EXAMPLE 4

The multilayer film backing of example 4 was prepared according to the procedure described in conjunction with example 1 except that the nominal film thickness was 63.5 μm and one surface of the film was provided with a 20.3 μm thick ethylene/acrylic acid primer layer (PRIMACOR 3330, commercially available from Dow Chemical Co.) extruded onto the film at 138° C. and cured with ultraviolet (UV) light energy.

EXAMPLE 5

The multilayer film backing of example 5 was prepared according to the procedure of example 2 except that the nominal film thickness was about 63.5 μm and the film included the primer layer of example 4. The multilayer film backing of this example displayed poor interlayer adhesion which it is believed can be remedied through the inclusion of an appropriate tie layer such as discussed more fully hereinabove. However, as shown in Table 2, the multilayer film of this example had excellent tear resistance.

Comparative Examples 1 to 3

A series of comparative examples, representing commercially available fourdiner paper backings for coated abrasive articles, was also tested for tear resistance with the results shown below in Table 3. Details concerning the backings of comparative examples 1 to 3 are reported in Table 1.

TABLE 1

| Example | Average Basis Weight ($g/m^2$)* | Source |
|---|---|---|
| C.E. 1 | 81 | E.B. Eddy Co. |
| C.E. 2 | 82.5 | Monadnock Paper Mills Inc. |
| C.E. 3 | 100 | Kimberly Clark Corp. |

*grams/square meter

Comparative Examples 4 to 6

A series of comparative examples, representing conventional, presently known polyester film backings for coated abrasive articles, was tested for tear resistance with the results shown below in Table 3. More specifically, each film comprised a single layer of polyethylene terephthalate, the thickness of which varied according to Table 2. Comparative examples 5 and 6 further included a primer layer (prepared according to example 4) on one surface thereof.

TABLE 2

| Example | Film Thickness (μm) |
|---|---|
| C. E. 4 | 63.5 |
| C. E. 5 | 76 |
| C. E. 6 | 127 |

Comparative Example 7

A 51 μm thick microvoided polyester film commercially available from ICI Americas, Inc. under the trade designation MELINEX was evaluated as a coated abrasive article backing with the results shown below in Table 3.

TABLE 3

| | Tear Resistance (g) | |
|---|---|---|
| Example | MD | TD |
| 1 | >1600 | >1600 |

TABLE 3-continued

| Example | Tear Resistance (g) MD | TD |
|---|---|---|
| 2 | >1600 | >1600 |
| 3 | 222 | >1600 |
| 4 | >1600 | >1600 |
| 5 | >1600 | >1600 |
| C.E. 1 | 73 | 78 |
| C.E. 2 | 94 | 84 |
| C.E. 3 | 167 | 165 |
| C.E. 4 | 64 | 64 |
| C.E. 5 | 72 | 74 |
| C.E. 6 | 154 | 163 |
| C.E. 7 | 34 | 27 |

The data of Table 3illustrate the substantially superior tear resistance of uncoated abrasive article backings based on multilayer films useful in the invention as compared to some presently known backings. Moreover, the backings of the invention were observed to be generally at least as flexible as, if not more flexible than, the same presently known backings.

While it is known to those skilled in the art that an abrasive layer or a supplemental layer on the backing may decrease the tear resistance of the coated abrasive article (relative to the backing alone), it will also be appreciated that backings with enhanced tear resistance improve the tear resistance of coated abrasive articles made therewith relative to less tear resistant backings.

A series of coated abrasive articles was prepared or provided as described below in example 6 and comparative examples 8 to 11. The resulting articles were tested for tear resistance using the procedure described above. Flexibility was measured in the Taber Flex Test described above. The results of these tests are reported below in Table 4.

EXAMPLE 6

The coated abrasive article of example 6 comprised a backing which included a multilayer film such as described hereinabove and an abrasive layer on one surface thereof. More specifically, the film comprised a total of 13 alternating layers of the stiff PET of example 1 coextruded with 5 weight % of the ductile material of the same example. The film was cast onto a chilled quenching wheel, sequentially oriented 2.6 times in the machine direction at 86° C. and 4.5 times in the transverse direction at 103° C., and heat set at 149° C. The film was about 51 μm thick and included an aziridene-based primer layer on both surfaces. The primer comprised 50 g of A.Q. 38 sulfonated polyester (available from Eastman Chemical Products, Inc.) diluted with water to a 4% solids aqueous solution, 0.8 g XAMA-7 aziridine-based material (available from Cordova Chemical Company), 50 g of ADCOTE 50T4983 (available from Morton International) diluted with water to a 4% solids aqueous solution, and 0.18 g TRITON X-100 surfactant (available from Rohm and Haas Company). The primer was applied after the film was oriented in the machine direction. The primer was subsequently dried and the primer coated film was then stretched in the transverse direction and heat set as described above.

The multilayer film backing was then provided with an abrasive layer prepared according to the following procedure. A make coat was prepared comprising a 48% solids ethylene/vinyl acetate emulsion (S-6005, commercially available from H. B. Fuller Company). The make coat was roll coated onto the backing at a wet weight of 42 g/m$^2$. Next, about 48 g/m$^2$ of grade 180 silicon carbide was electrostatically projected into the make coat. The resulting construction was heated for 20 minutes at 71° C. A size coat was prepared comprising 86.6 parts of a urea formaldehyde resin (commercially available from Borden Chemical under the trade designation AL8405), 1.75 parts of $AlCl_3$ catalyst, and 11.65 parts of an acrylic latex resin (commercially available from B. F. Goodrich under the trade designation HYCAR 2679). The size coat was roll coated over the abrasive particles/make coat with a wet weight of 50 g/m$^2$. The resulting construction was heated for 15 minutes at 49° C. and then for 45 minutes at 82° C.

Next a supersize coating was prepared by mixing:

74.5 parts water;

5.0 parts ethylene glycol monoethyl ether;

17.0 parts zinc stearate (average particle size of 12 μm);

0.62 part sodium dioctyl sulfosuccinate;

0.50 part DEFOAMER 1512, hydrocarbon antifoaming agent (commercially available from Hercules, Inc.);

1.60 parts methyl cellulose (A15-LV, commercially available from Dow Chemical Co.); and 0.70 part cellulose gum (AQUALON CMC-7-M, commercially available from Aqualox).

The supersize coating was applied over the size coat at a wet weight of 59 g/m$^2$. The resulting construction was dried for 24 hours at room temperature to form the coated abrasive article. The article was then flexed over a 2.54 cm diameter rod to improve the flexibility of the article as is conventional in the industry.

Comparative Examples 8 and 9

Comparative examples 8 and 9 were prepared by applying the abrasive layer of example 6 to the backings of, respectively, comparative examples 2 and 3, following the procedure of example 6.

Comparative Examples 10 and 11

Comparative examples 10 and 11 were commercially available coated abrasive articles. The coated abrasive article of comparative example 10 was grade 180 415 N TRI-M-ITE FRE-CUT using a paper backing and commercially available from Minnesota Mining and Manufacturing Company. Comparative example 11 was a 30 μm A245 A217 coated abrasive article using a polyester film backing commercially available from Norton Co.

In addition to the tear resistance and flexibility testing reported in Table 4 below, example 6 and comparative examples 8 to 10 were also evaluated for their ability to abrade a workpiece with the results shown in Table 4 . More specifically, the coated abrasive articles from these examples were die cut to provide 10.2 cm diameter discs that were bonded to a foam back-up pad with a pressure sensitive adhesive. The coated abrasive disc and foam back-up pad were mounted in a Schiefer testing apparatus to abrade a cellulose acetate butyrate polymer workpiece for 500 revolutions under a 4.5 kg load. The workpiece was a disk having an opening through a central portion thereof. The outside diameter of the disk was 10.2 cm and the inside diameter was 5.1 cm. The amount of abraded polymer was weighed. The surface finish of the abraded workpiece was assessed by measuring $R_a$ (the arithmetic average of the scratch depth in microinches (μin)) and $R_{tm}$ (the mean of the maximum peak to valley scratch depth in μin).

TABLE 4

| Example | Tear Resistance (g) MD | Tear Resistance (g) TD | Taber Flex Test (g) MD | Taber Flex Test (g) TD | Material Abraded (g) | $R_a$ (μin) | $R_{tm}$ (μin) |
|---|---|---|---|---|---|---|---|
| 6 | 634 | 891 | 2.5 | 3.4 | 2.57 | 64 | 414 |
| C.E. 8 | 150 | 169 | 5.8 | 4.4 | 2.37 | 56 | 355 |
| C.E. 9 | 209 | 202 | 11.0 | 5.3 | 2.08 | 56 | 348 |
| C.E. 10 | 121 | 140 | 8.1 | 5.0 | 2.39 | 48 | 316 |
| C.E. 11 | 131 | 131 | NT | NT | NT | NT | NT |

NT = not tested

The data of Table 4 show the significant improvement in tear resistance coupled with enhanced flexibility achieved by coated abrasive articles according to the invention as compared to some presently known coated abrasive articles. Table 4 further shows that the coated abrasive article of example 6 had a higher cut rate (i.e., more material was abraded) than the coated abrasive articles of comparative examples 8 to 10 but with a slightly rougher finish.

EXAMPLE 7

A tear resistant multilayer film coated abrasive article backing was prepared by coextruding the stiff PET of example 1 with 5.6 wt. % of the ductile copolyester of the same example into a 13 layer film about 51 μm thick. The film was subsequently sequentially oriented 3.3 times in both the machine and transverse directions at 99° C. and heat set at 191° C. The backing was pretreated to improve adhesion to the subsequently applied make coat by exposing the backing to approximately 350 millijoules/square centimeter of UV light radiation at a rate of about 30.5 meters/minute.

A make coat similar to that described in conjunction with example 6 was roll coated onto the backing at a wet weight of about 25 g/m$^2$. Grade P220 aluminum oxide abrasive particles were electrostatically coated into the make coat at a weight of 55 g/m$^2$. The make coat was cured in a 85° C. tunnel oven for approximately 1 minute.

A size coat prepared as in example 6 was applied over the abrasive particles/make coat at a wet weight of 46 g/m$^2$ and cured in the same manner as example. 6. This was followed by the application of a supersize coating prepared as in example 6 and roll coated at a wet weight of 42 g/m$^2$.

EXAMPLE 8

A coated abrasive article was prepared comprising an abrasive layer on a tear resistant multilayer film backing prepared according to example 4. The abrasive layer included a 48% solids make coat comprising 62.53 parts phenol-formaldehyde resin, 0.47 part INTERWET 2323 (a glycol ester of a fatty acid commercially available from AKZO America), and 36.97 parts ethylene glycol monoethyl ether. 50 g/m$^2$ of grade P320 aluminum oxide abrasive particles were electrostatically projected into the make coat which was subsequently applied to the backing at a wet weight of 10 g/m$^2$. The make coat was cured by heating at 68° C. for 40 minutes followed by heating at 102° C. for 45 minutes.

A 56% solids size coat comprising 72.54 parts phenol-formaldehyde resin, 4.34 parts NIGROSINE JET BLACK dye (commercially available from Keystone Imports, 20% solids), and 23.11 parts ethylene glycol monoethyl ether was coated onto the abrasive particles/make coat at a wet weight wet of 42 g/m$^2$. The size coat was subsequently cured for 30 minutes at 88° C., then 30 minutes at 102° C., and then 2.5 hours at 110° C.

The resulting coated abrasive article was flexed over a 2.54 cm diameter rod.

EXAMPLE 9

A coated abrasive article comprising the multilayer film backing of example 4 and an abrasive layer was prepared. The abrasive layer included a 44% solids make coat based on 43.36 parts phenol-formaldehyde resin, 15.62 parts of a nonreactive aliphatic polyester plasticizer, 0.42 part of a fluorocarbon surfactant (FC-430, commercially available from Minnesota Mining and Manufacturing Co.), and 40.59 parts propylene glycol monomethyl ether. 63 g/m$^2$ of grade P320 aluminum oxide abrasive particles were electrostatically coated into the make coat that had been previously roll coated onto the backing at a wet weight of 15 g/m$^2$. The abrasive particles/make coat was then cured using the temperature profile of example 8.

A 58% solids size coat was then prepared comprising 67.12 parts phenol-formaldehyde resin, 7.54 parts of the above plasticizer, 0.85 part INTERWET 2323, 14.68 parts propylene glycol monomethyl ether, and 9.79 parts water. The size coat was roll coated over the abrasive particles/make coat at a wet weight of 46 g/m$^2$ and cured as described in example 8. The resulting coated abrasive article was flexed over a 2.54 diameter rod.

Comparative Example 12

A coated abrasive article comprising the abrasive layer of example 8 on the backing of comparative example 5 was prepared following the procedure of example 8.

Comparative Example 13

A coated abrasive article comprising the abrasive layer of example 9 on the backing of comparative example 7 was prepared following the procedure of example 9.

The coated abrasive articles of examples 7 to 9 and comparative examples 12 and 13 were tested for tear resistance, flexibility, and their ability to abrade a workpiece, all as described more fully above, with the results shown below in Table 5.

TABLE 5

| Example | Tear Resistance (g) MD | Tear Resistance (g) TD | Taber Flex Test (g) MD | Taber Flex Test (g) TD | Material Abraded (g) | $R_a$ (μin) | $R_{tm}$ (μin) |
|---|---|---|---|---|---|---|---|
| 7 | 408 | 606 | 2.0 | 2.0 | 1.69 | 48 | 304 |
| 8 | 280 | 351 | 13.7 | 14.0 | 0.54 | 48 | 275 |
| 9 | 269 | 332 | 17.3 | 18.7 | 0.47 | 41 | 247 |
| C.E.12 | 112 | 90 | 23.8 | 22.5 | 0.41 | 47 | 269 |
| C.E.13 | 134 | 102 | 16.6 | 17.3 | 0.38 | 42 | 335 |

The data of Table 5 show that coated abrasive articles comprising a multilayer film backing such as described above are substantially more tear resistant than coated abrasive articles incorporating presently available backings as well as being more flexible. Furthermore, the coated abrasive articles of the invention yielded a comparable cut rate and surface finish.

Comparing example 8 with comparative example 12 and example 9 with comparative example 13 illustrates the improvement in tear resistance that can be achieved by substituting a backing which includes a multilayer film for a presently available backing.

Numerous variations and modifications are possible within the foregoing specification and drawings without departing from the scope of the invention which is described in the accompanying claims.

The embodiments for which an exclusive property or privilege is claimed are defined as follows:

1. A tear resistant coated abrasive article comprising:

a backing which comprises a film having at least five layers situated one on the other in a parallel array, the layers occurring essentially randomly in the array and being individually selected from a stiff polyester or copolyester and a ductile polymeric material; and an abrasive layer on a surface of the backing.

2. A tear resistant coated abrasive article according to claim 1 wherein the stiff polyester or copolyester layers are oriented in at least one direction.

3. A tear resistant coated abrasive article according to claim 1 wherein the layers of the stiff polyester or copolyester have an average nominal thickness of greater than 0.5 μm.

4. A tear resistant coated abrasive article according to claim 1 wherein the article has an Elmendorf tear test value of at least 200 grams in one direction of the article.

5. A tear resistant coated abrasive article according to claim 4 wherein the article has an Elmendorf tear test value of at least 250 grams in one direction of the article.

6. A tear resistant coated abrasive article according to claim 1 wherein the number of layers in the film does not exceed about 35.

7. A tear resistant coated abrasive article according to claim 6 wherein the number of layers in the film is 13.

8. A tear resistant coated abrasive article according to claim 1 wherein the stiff polyester or copolyester comprises the reaction production of (a) a dicarboxylic acid component selected from the group consisting of terephthalic acid, naphthalene dicarboxylic acid and ester derivatives thereof and (b) a diol component selected from the group consisting of ethylene glycol and 1,4-butanediol.

9. A tear resistant coated abrasive article according to claim 8 wherein the stiff polyester or copolyester has a tensile modulus at the temperature of interest of greater than 200 kpsi.

10. A tear resistant coated abrasive article according to claim 1 wherein the ductile polymeric material is selected from the group consisting of ethylene copolymers, polyesters, copolyesters, polyolefins, polyamides, and polyurethanes.

11. A tear resistant coated abrasive article according to claim 10 wherein the ductile polymeric material is a copolyester comprising the reaction product of cyclohexane dicarboxylic acid (or an ester derivative thereof), cyclohexane dimethanol and polytetramethylene glycol.

12. A tear resistant coated abrasive article according to claim 10 wherein the ductile polymeric material is an ethylene/vinyl acetate copolymer having from 5% to 30% by weight vinyl acetate.

13. A tear resistant coated abrasive article according to claim 10 wherein the ductile polymeric material has a tensile modulus of less than 200 kpsi at the temperature of interest.

14. A tear resistant coated abrasive article according to claim 13 wherein the ductile polymeric material has a tensile elongation of greater than 50% at the temperature of interest.

15. A tear resistant coated abrasive article according to claim 1 wherein the film is about 7 to 500 μm thick.

16. A tear resistant coated abrasive article according to claim 1 wherein the ductile polymeric material provides at least about 1 weight percent of the film.

17. A tear resistant coated abrasive article according to claim 16 wherein the ductile polymeric material provides from about 5 to 7 weight percent of the film.

18. A tear resistant coated abrasive article according to claim 16 wherein the ductile polymeric material provides at most about 20 weight percent of the film.

19. A tear resistant coated abrasive article according to claim 1 wherein the film further comprises a layer of an intermediate material disposed between otherwise adjacent layers of stiff polyester or copolyester and ductile polymeric material.

20. A tear resistant coated abrasive article according to claim 19 wherein the layer of intermediate material enhances the adhesion between the otherwise adjacent layers of stiff polyester or copolyester and ductile polymeric material.

21. A tear resistant coated abrasive article according to claim 1 wherein the layers of ductile polymeric material have an average nominal thickness of less than 5 μm.

22. A tear resistant coated abrasive article according to claim 1 wherein the backing further comprises a supplemental layer on the film.

23. A tear resistant coated abrasive article according to claim 22 wherein the supplemental layer comprises a material selected from the group consisting of cloth, vulcanized fibers, paper, nonwoven goods, polymeric films and combinations thereof.

24. A tear resistant coated abrasive article according to claim 1 wherein the abrasive layer comprises a first binder over the backing and a multiplicity of abrasive particles in the first binder.

25. A tear resistant coated abrasive article according to claim 24 wherein the first binder is a glue or a resinous adhesive.

26. A tear resistant coated abrasive article according to claim 25 wherein the resinous adhesive for the first binder is selected from the group consisting of phenolic, aminoplast, urethane, epoxy, isocyanaurate, ethylenically unsaturated, urea-formaldehyde bis-maleimide, and fluorine-modified epoxy resins as well as mixtures thereof.

27. A tear resistant coated abrasive article according to claim 24 wherein the abrasive layer further comprises a second binder over the first binder.

28. A tear resistant coated abrasive article according to claim 27 wherein the second binder is a glue or a resinous adhesive.

29. A tear resistant coated abrasive article according to claim 28 wherein the resinous adhesive for the second binder is selected from the group consisting of phenolic, aminoplast, urethane, epoxy, isocyanaurate, ethylenically unsaturated, urea-formaldehyde bis-maleimide, and fluorine-modified epoxy resins as well as mixtures thereof.

30. A tear resistant coated abrasive article according to claim 27 further comprising a third binder over the second binder.

31. A tear resistant coated abrasive article according to claim 30 wherein the third binder reduces the accumulation of swarf.

32. A tear resistant coated abrasive article according to claim 24 wherein the abrasive layer further comprises a super size coating over the first binder.

33. A tear resistant coated abrasive article according to claim 24 wherein the abrasive particles are selected from the group consisting of aluminum oxide-based materials, silicon carbide, cofused alumina-zirconia, diamond, ceria, cubic boron nitride, garnet and blends thereof.

34. A tear resistant coated abrasive article according to claim 1 further comprising a back size coating on a surface of the backing opposite the surface which has the abrasive layer thereon.

35. A tear resistant coated abrasive article according to claim 34 wherein the back size coating is a pressure sensitive adhesive.

36. A tear resistant coated abrasive article according to claim 34 wherein the back size coating is electrically conductive.

37. A tear resistant coated abrasive article according to claim 1 further comprising an adhesion promoting primer layer between the abrasive layer and the backing.

38. A tear resistant coated abrasive article according to claim 25 wherein the resinous adhesive for the first binder is selected from the group consisting of acrylated urethane, acrylated epoxy and acrylated isocyanurate resins as well as mixtures thereof.

39. A tear resistant coated abrasive article according to claim 28 wherein the resinous adhesive for the second binder is selected from the group consisting of acrylated urethane, acrylated epoxy and acrylated isocyanurate resins as well as mixtures thereof.

* * * * *